United States Patent [19]

Bailey

[11] Patent Number: 4,782,336

[45] Date of Patent: Nov. 1, 1988

[54] TWO DIMENSIONAL VISUAL DISPLAY

[75] Inventor: John E. Bailey, Rykkinn, Norway

[73] Assignee: Ferrnati, PLC, Cheadle, England

[21] Appl. No.: 631,878

[22] Filed: Jul. 18, 1984

[30] Foreign Application Priority Data

Jul. 26, 1983 [GB] United Kingdom ..... 8320171

[51] Int. Cl.[4] ..... G09G 3/32

[52] U.S. Cl. ..... 340/752; 340/754; 340/762; 340/815.03; 340/815.1

[58] Field of Search ..... 340/701, 754, 755, 762, 340/792, 815.03, 815.08, 815.01, 815.15, 815.27, 718, 719; 40/540, 550; 339/103 M; 362/391

[56] References Cited

U.S. PATENT DOCUMENTS

| | | | |
|---|---|---|---|
| 4,162,493 | 7/1979 | Ross et al. | 340/752 |
| 4,173,035 | 10/1979 | Hoyt | 362/806 |
| 4,179,832 | 12/1979 | Lemelson | 340/550 X |
| 4,388,589 | 6/1983 | Molldrum, Jr. | 324/96 |
| 4,488,149 | 12/1984 | Givens, Jr | 340/715 X |

FOREIGN PATENT DOCUMENTS

| | | |
|---|---|---|
| 1104303 | 2/1968 | United Kingdom . |
| 1273667 | 5/1972 | United Kingdom . |
| 1542726 | 3/1979 | United Kingdom . |
| 1594151 | 7/1981 | United Kingdom . |

*Primary Examiner*—Gerald L. Brigance
*Assistant Examiner*—Jeffery A. Brier
*Attorney, Agent, or Firm*—Kerkam, Stowell, Kondracki & Clarke

[57] ABSTRACT

A two-dimensional visual display comprises one or more groups of one dimensional display components 12 (FIG. 2), each component being formed by spaced individually energizable display elements 11, conveniently l.e.d. groups, attached to a multiconductor cable 13. Each display component has serial input shift register means formed by separate m-stage shift registers 17 disposed along the cable each feeding display energizing signals from stage outputs to m adjacent display elements enabling the same m conductors of the cable to be isolated (at 17') and used to connect each shift register to its associated display elements irrespective of the number along the component.

The, or each, group comprises 8 components and the shift registers of the group are addressed in parallel by single bits of a stream of words produced by an 8-bit microprocessor and representing the message to be displayed by the display elements.

21 Claims, 3 Drawing Sheets

Figure 1:
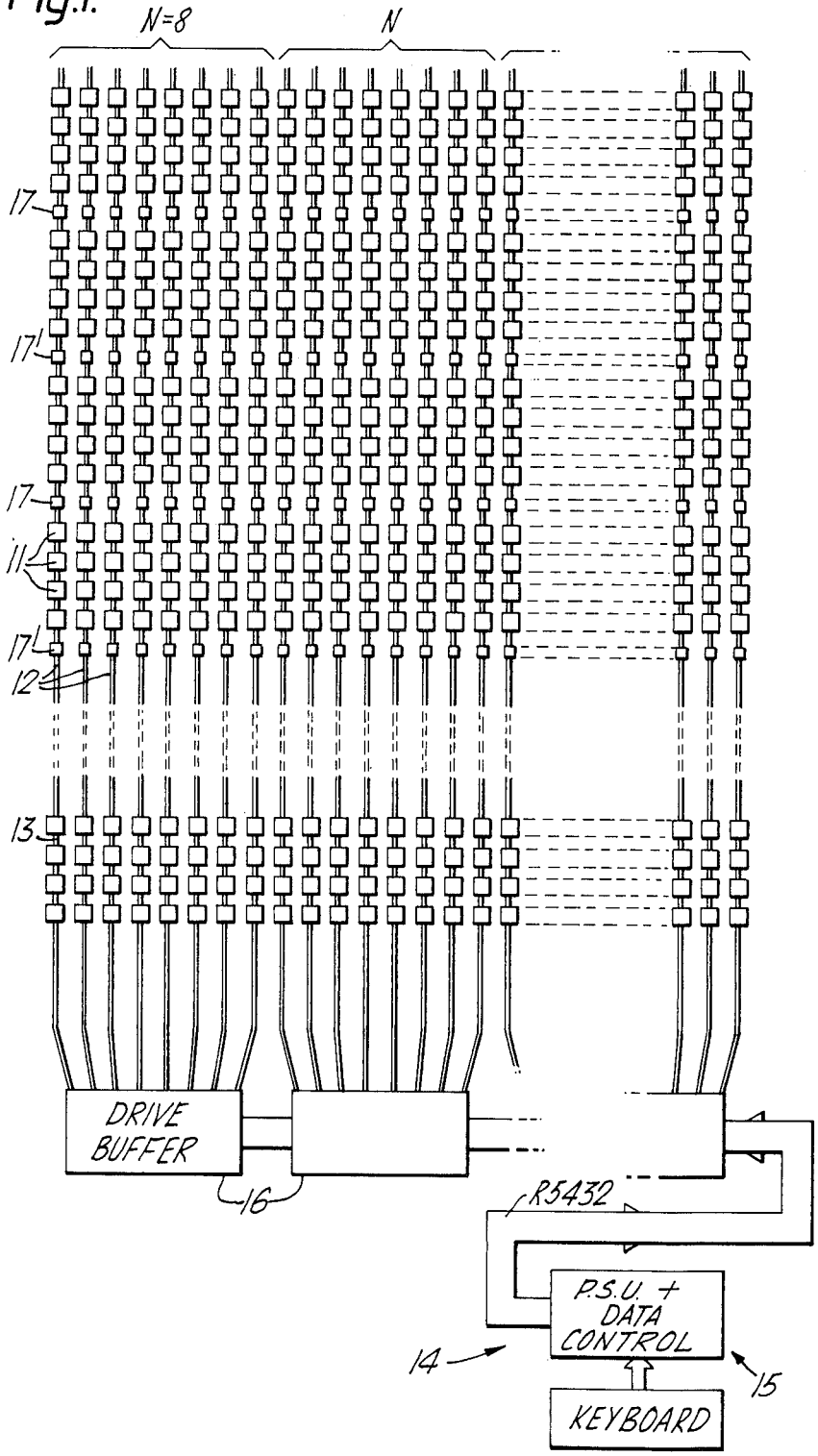

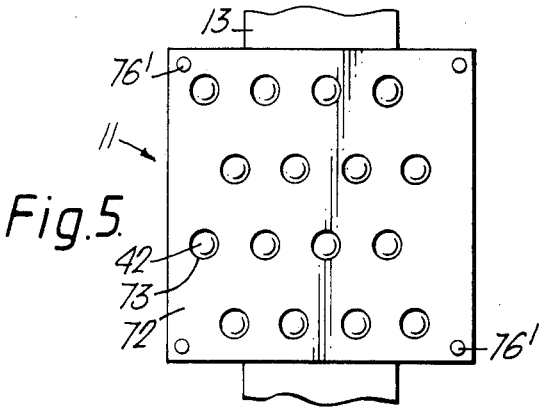
Fig.5.
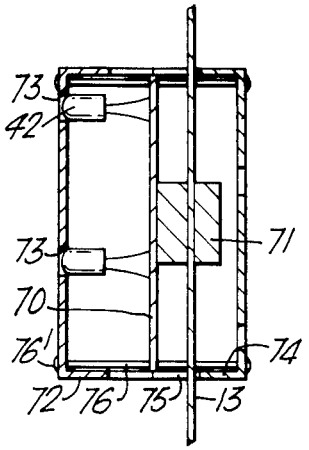
Fig.6.
Fig.7.
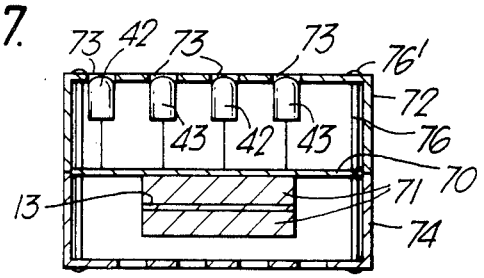
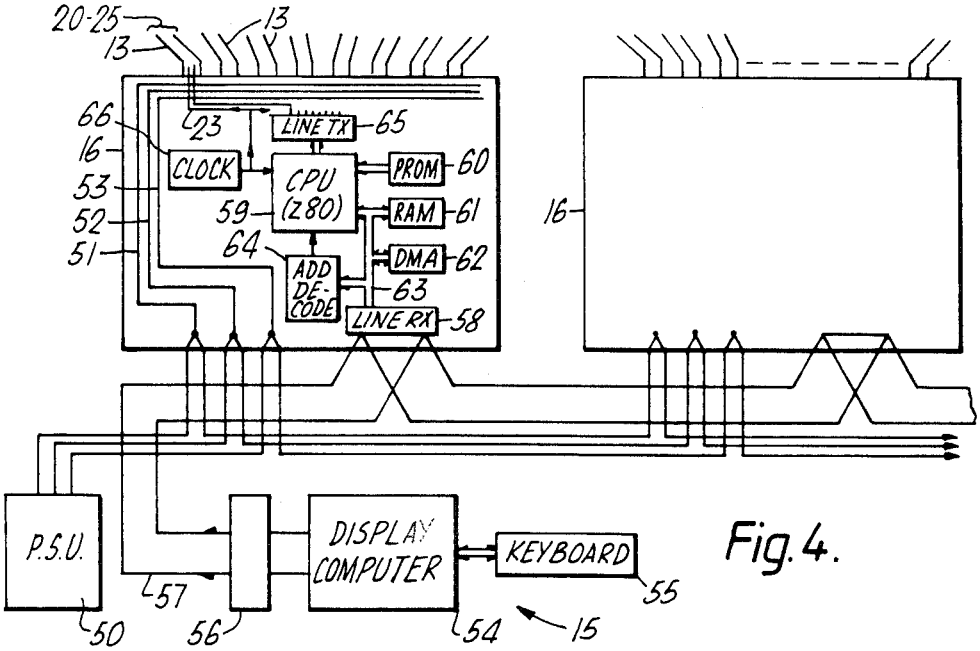
Fig.4.

TWO DIMENSIONAL VISUAL DISPLAY

This invention relates to visual displays of the type comprising a two-dimensional array of energisable display elements or pixels in discrete form interconnected by element energising means. The type of display with which this invention is concerned may be referred to as a 'large scale displays', meaning that each display element is separately assembled in the display and the term is intended to exclude the so-called integrated displays in which plurality of pixels and their addressing means are contained within a single envelope.

In this specification the term 'energisable' is used in relation to a form of display or display element which when energised changes its appearance, for example, by physically positioning or shuttering a portion of different reflectivity or by emitting light (illuminated).

The invention is concerned particularly, but not exclusively, with large scale displays intended to be viewed from distances of several hundreds of meters and therefore occupying an area of several tens of square meters.

It is an object of the invention to provide a two-dimensional visual display which substantial identity between parts thereof enables a large scale display to be formed of simple construction.

According to the present invention a two dimensional visual display comprises at least one group of one-dimensional display components each formed by a plurality of individually energisable display elements associated with a serial input shift register means having an output for each stage thereof connected to cause energisation of an individual display element of the display component and display driving means operable to generate a stream of binary driving words and apply corresponding single bits of each word of the stream to an individual shift register means so that successive words of the stream are shifted from display element to display element along each component.

Each display component may comprise a multiconductor electrical cable to which the display elements are attached to support them and by which signals causing energisation of the elements are supplied thereto.

The shift register means may be carried by the multiconductor cable and distributed along the cable in the form of a plurality of m-stage shift registers associated each with an individual section of successive display elements having m energisation switches and the serial inputs of the shift register of each section being derived from the output of the register of the preceding section connecting the shift register output to the display elements being isolated from corresponding conductors in adjacent sections.

In this way irrespective of how many sections, each with m display element inputs and shift registers, are employed in each display component the cable requires only m energising conductors plus one each for clocking the shift registers and serial transfer between shift registers.

An embodiment of the invention will now be described by way of example with reference to the accompanying drawings, in which:

FIG. 1 is an overall view of a two dimensional display according to the present invention showing the disposition of energisable display elements and display driving means.

Figure 2:
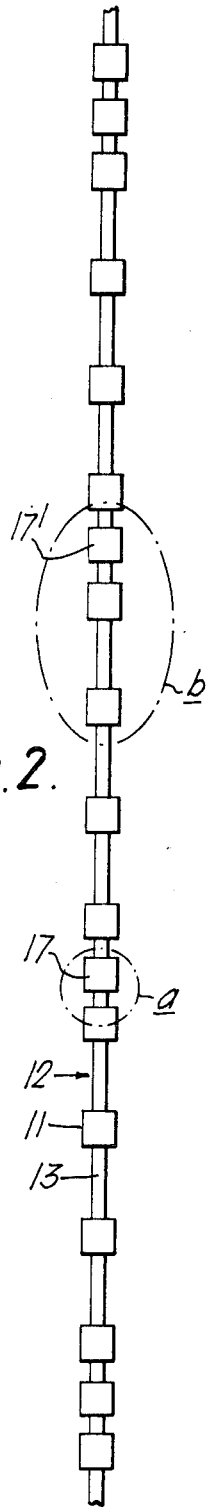
Figure 3B:
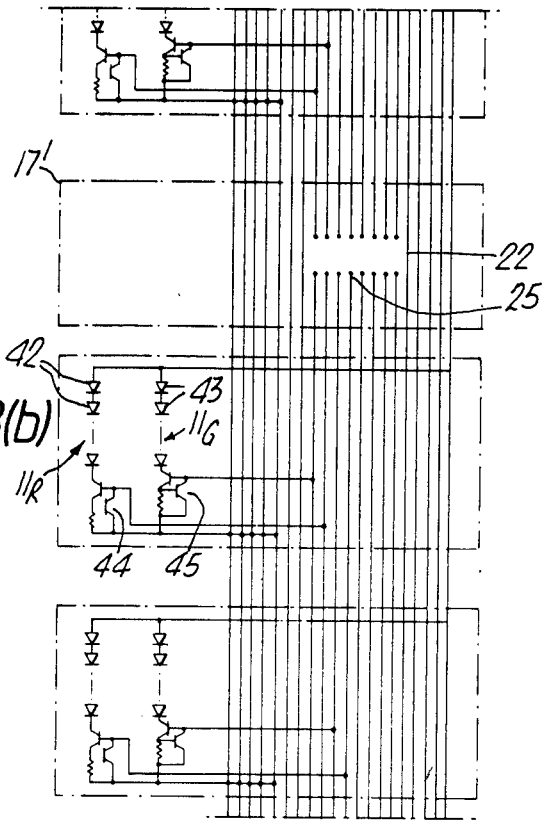
Figure 3A:
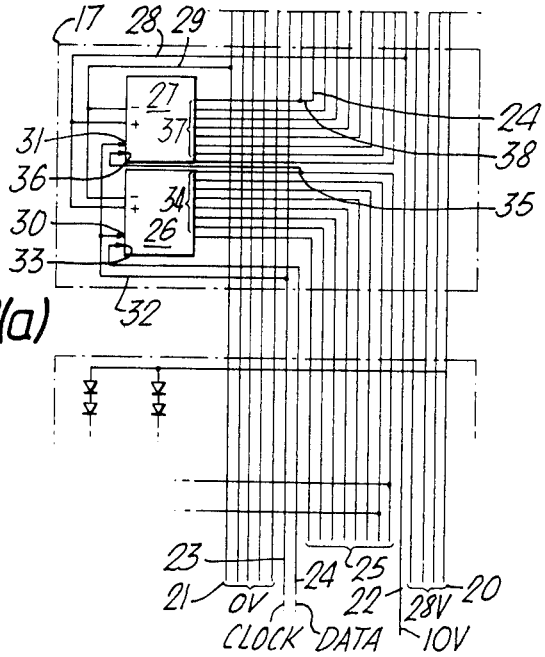

FIG. 2 is a more detailed view of a portion of one display component comprising one column of the display of FIG. 1, FIGS. 3(*a*) and 3(*b*) are schematic representations of the electrical circuit arrangement of the portions of display component of FIG. 2 shown ringed, FIG. 4 is a block circuit diagram of a portion of the display driving means, FIG. 5 is a front view of one of the display elements, FIG. 6 is a sectional side elevation through the element of FIG. 5, and FIG. 7 is a sectional end elevation through the element of FIG. 5.

Referring to FIG. 1 the two-dimensional visual display 10 takes the form of a rectangular matrix of energisable display elements 11. In this embodiment the display elements are energisable to become illuminated and in fact contain sources of illumination of different colour energisable independently. Each independently energisable colour source may be considered as an illumination element and in this embodiment each display element contains red and green, that is, two, illumination elements $\mathbf{11}_R$ and $\mathbf{11}_G$.

In accordance with the present invention the two-dimensional display is formed by groups of one-dimensional display components 12 each comprising a plurality of individually energisable display elements 11 supported on, and connected to be energised by a multiconductor electrical cable 13. Each group contains N (=eight) display components and the cables thereof are connected to display driving means, shown generally at 14, comprising a driving computer and power supply unit 15 and for each group of display components a drive buffer 16.

Each display component also includes shift register means in the form of a plurality of shift register-carrying boards 17 and isolator boards 17' distributed at intervals along the cable 13.

Referring to FIG. 2 this shows a portion of one display component 12 in greater detail than FIG. 1.

The multiconductor cable 13 is conveniently formed by a flat ribbon cable to which are connected at regularly spaced intervals display elements 11. Between each set of four successive display elements (that is, eight illumination elements) is a board of the distributed shift register means, the boards 17 and 17' being disposed alternately.

The cable 13, ringed portion a, comprising a shift register board 17, and the ringed portion b, comprising an isolator board 17' and two display elements 11, are shown in greater electrical detail in FIGS. 3(*a*) and 3(*b*) respectively.

The ribbon cable 13 requires thirteen separate conductors but to enable the supply of adequate current to the illumination elements while retaining minimal cable parameters a twenty-conductor cable is employed, four of said conductors comprising a 28 volt supply rail 20 and five of the conductors comprising a 0 volt return rail 21. Of the other conductors, one 22 comprises a 10 volt supply rail for the shift register boards 17, 23 carries clocking pulses to all the shift registers, 24 carries shift data from one shift register to the next and the eight conductors 25 connect the shift register outputs to the energising inputs of associated display elements.

Referring to FIG. 3(*a*) a shift register board 17 contains two eight-bit shift registers 26 and 27 each connected by lines 28, 29 to power rails 22 and 21 and with clock inputs 30, 31 connected by line 32 to clock rail 23.

Shift register 26 has a serial input terminal 33 to which the data line 24 is connected and eight stage outputs shown at 34 to which are connected the eight conductors 25 extending downwardly of the board as shown in the Figure. The highest stage output is connected at 35 to a serial input terminal 36 of the register 27. The register 27 also has eight stage outputs shown at 37 to which are connected the eight conductors 25 extending upwardly of, the board as shown in the Figure. The highest stage output is connected at 38 to a continuation of the serial data line 24 extending to the next shift register board.

Considering the eight outputs from shift register 27 the conductors 25 extend along the cable beyond four display elements (eight illumination elements) and are shown in FIG. 3 (*b*) terminating at an isolator board 17'. The same conductor group, electrically isolated extend from the next (higher) shift register (not shown) down to the isolator board, also serving eight illumination elements. The other conductors 20–24 continue unbroken through the isolator but may, for manufacturing reasons, form junctions between separate cable lengths.

Considering the display elements 11, each comprises two illumination elements $11_R$, $11_G$ formed each by a serially connected string of high intensity light emitting diodes (42, 43) and an energising switch 44, 45 respectively connected between the power rails 20 and 21. The illumination elements are arranged to operate independently in accordance with energisation of the switch and to emit red or green light, or any combination thereof.

The diodes 42, emitting red light are Stanley type SBR 5501 and the diodes 43, emitting green light are Stanley type ESBG 5501. The different device types have different operating characteristics and it is convenient to develop and identical voltage drop of about 21 volts across each string by having in series 9 red emitting diodes 42 and 7 green emitting diodes 43.

For each display element, power supply connection is made by tapping the power rails 20 and 21 and the energising signals to the switches 44 and 45 are obtained by tapping the conductor group 25.

As stated above each section of conductors 25 is associated with eight illumination elements and the conductors are tapped by the element energising switches such that the switches disposed along the display component are energised in turn by successive stages of the shift register means.

The cables 13 of the display components of each group of eight are connected to a drive buffer 16 associated with the display driving means 15 and shown in greater detail in FIG. 4.

The display driving means 15 comprises a power source 50 having 0 v, 10 v and 28 v outputs each connected to one of three power buses 51, 52, 53 in the drive buffer 16.

The display format is determined within a suitably programmed microcomputer 54 from data inputs from an alphanumeric keyboard or graphical tablet indicated at 55. The functioning of the computer and the program by which it operates are not of importance to an understanding of the invention and will not be described in detail but it is required to produce for each drive buffer a buffer identification code followed by a block of data in the form of a stream of 8-bit words, the number of words being equal to the number of elements of a display component. The buffer identification codes and data are transmitted in sequence for the number of drive buffers in the display and may be repeated cyclically or only when the display is to be changed, such as when new information is input.

The driving data is carried by way of an interface 56 on an interconnecting bus 57 which connects to each drive buffer 16 at a line receiver 58.

Each drive buffer comprises an 8-bit microprocessor CPU 59, such as a Zilog Z80 with a PROM 60 containing the operating instructions by which the buffer functions, a RAM 61 which comprises working memory for the CPU and storage area for the display defining words received from the computer 54 and a DMA controller 62 by which said words are loaded into the memory. An address/data bus 63 connects the line receiver 58 to the CPU and its peripheral devices and also to a decoder 64 which reponds to the identification code prefacing each block of data designating that buffer to interrupt the CPU and load the data into the RAM store.

The CPU also has an output data bus connected to a line transmitter 65 having eight outputs (one per bit of each 8-bit word from the CPU) and a clock 66 timing operation of the CPU.

The multiconductor cable 13 described in relation to FIG. 3(*a*) with its conductors (or conductor group) 20–25 is connected to the drive buffer with the power conductors 20, 21 and 22 connected to the power buses 53, 51 and 52 respectively the clock line 23 connected to an output of clock 66 and the shift data line 24 connected to one output terminal of the transmitter 65. The other seven cables of adjacent display components are similarly connected, the only points of difference being the connection of the respective shift data lines to different outputs of the line transmitter 65. The conductor group 55 of each cable is merely anchored to the buffer board without electrical connection.

To produce a display the drive computer 54 sends blocks of words to each drive buffer in turn at high speed, which thereafter drive each group of display components in parallel. Each drive buffer reads the words from the RAM one at a time one applies one bit of each to corresponding data line 24 by way of the line transmitter 65. The words are read at a rate governed by clock 66 which also clocks the shift register means of the display components to shift the bits along the display component, addressing the energising switch 44 or 45 of each illumination element in turn until the number of words corresponding to the number of illumination elements have been read and shifted.

Clearly after each shift an energisation signal is produced by a shift register output and some of the illumination elements are energised but to avoid emission of light the clocking rate is of sufficiently high rate that no visible display appears until the clocking is ended, at which time those illuminated elements energised comprise the display. Furthermore the display remains without refresh until it is desired to change the display.

It will be appreciated that if desired the information can be shifted along the display components at a slower rate becoming visible at each stage and appearing as a travelling message.

As stated the display is particularly suited to a large scale and where the display elements 11, which may be used in large numbers, are substantially identical in construction and readily secured within the electrical circuitry. Referring now to FIGS. 5, 6 and 7 these show in greater detail the physical construction of a display element 11 comprising, in the terminology of this specification, two illumination elements $11_R$ and $11_G$. The display element comprises a circuit board 70 to the centre of which is soldered part of a stand-off insultion-piercing connector 71, which together with a second part attaches the display element 11 to the cable 13 and makes electrical connection to appropriate conductors of the cable. The circuit board 70 also carries the light sources of the illumination elements disposed in rows each side of the connector the sources being said serially connected high intensity emitting diodes, 42 and 43 interspersed in position.

The circuit board and diodes are protected by a cover 72 of moulded thermoplastics material having apertures 73 therein corresponding to the disposition of the diode sources and through which the emitting ends of the diodes project. The cover also supports the diodes against bending of the leads by mechanical shock. Complementing the cover 72 is a base part 74 also formed as a thermoplastics moulding which protects the connector 71 and provides mechanical support therefor against lateral and rotational forces by cable entrance notches 75. The cover 72 and base part 74 may be formed by the same design of thermoplastics moulding, the apertures 73 in the base and notches 75 in the cover being redundant.

The cover 72 and base 74 may be joined separately to the circuit board 70 and/or to each other. Conveniently, the cover and base are joined to each other, sandwiching the circuit board, by fastening pins 76 of thermoplastics material which extend through aligned apertures in the corner of the cover and base and which are heated and deformed to form retaining heads 76'.

It will be appreciated that the display elements may be other than illuminated, that is, light emitting. They may for instance be light reflective, either with ambient or specially incident light, and energisable to display reflective properties by means of electro-optical or electromechanical shuttering. An example of such an element is the electromagnetic light reflective disk display proced by Ferranti-Packard Electronics Limited of Ontario, Canada.

The display formed of display components comprising essentially continuous multiconductor cable on which the display elements are mounted favours a construction in which said display conductors extend vertically e.g. by hanging from one end such that supporting structure for each display element is not required. It will be appreciated however that there is no restriction to such a configuration and may be formed with the display components extending horizontally or any other direction. Furthermore the display elements need not be disosed as a rectangular matrix, the different display components being provided with display elements at locations in accordance with the formation of any particular display.

Other features which may be varied will be apparent and include the number of display component groups and the number of components in each group. The low cost and availability of 8-bit microprocessors makes groups of eight convenient to handle but it will be appreciated that variations can be made using processors of different word length or that with any drive buffer processor a lesser number of components may be energised, the remaining bits of the words being redundant, or utilised in some checking function.

Although not restricted to any specific dimensions the construction of the display is suited for instance to a display of overall dimensions say 4 meters×25 meters formed by say 200 display components each comprising 32 display elements. Such a construction provides a rectangular array of display elements enabling energisation addresses to be readily determined. The distribution of display elements within each component or of display components may be varied in accordance with any specific display requirements.

I claim:

1. A two dimensional visual display device comprising:

at least one group of one dimensional display components;

each display component comprising:

a multiconductor cable extending for the length of the component and having power supply conductors, a data conductor and a predetermined number m of switching signal conductors;

isolation means carried by the cable for electrically separating each conductor of said switching signal conductors into successive lengths of the multiconductor cable, thereby sub-dividing the cable into a plurality of sections along the length of the component; and for each section repeated along the cable a set of individually energizable display elements carried by and distributed along the cable section, each element having associated therewith a preset number of energization switches and the set having associated therewith m energization switches, each of said energization switches connected to one of said switching signal conductors, and a shift register carried by the cable having m register stages, successive stages being connected individually to energization switches associated with respective successively disposed display elements, and connected serially with said data conductor to receive serial shift signals from a preceding section; and display driving means operable to generate a stream of multiple bit binary words and apply corresponding single bits of each word of the stream to said data conductor of an individual display component so that successive words of the stream are shifted between corresponding display element energization switches of the components of each group.

2. A display as claimed in claim 1 in which each group comprises up to a predetermined number N of display components and the driving means is operable to produce a stream of N-bit driving words, corresponding bits of each driving word of the stream being applied simultaneously to corresponding ones of the data conductors.

3. A display as claimed in claim 2 in which each group of a plurality of groups has associated therewith a drive buffer arranged to receive a stream of driving words for the associated group only and operable to apply the component bits of said words of the stream serially to corresponding data conductors.

4. A display as claimed in claim 3 in which the driving means is arranged to transmit the stream of driving words for each group in sequence along a common drive bus to which all the drive buffers are connected, and each drive buffer includes a decoder operable to recognize and permit reception of the stream of driving words for the group of display components associated herewith.

5. A display as claimed in claim 4 in which each drive buffer includes data storage means and buffer control means operable to route the stream of driving words from the display driving means to the data storage means and thereafter to apply them to the shift register means.

6. A display as claimed in claim 5 in which the buffer control means comprises an N-bit microprocessor including a RAM comprising the data storage means, a CPU for reading data from the RAM to drive the shift register means, a ROM containing the operation instructions for the CPU, a direct memory access (DMA) controller for loading data directly from the common bus into the RAM, and receiving and transmitting bus interfaces.

7. A display as claimed in claim 6 in which the decoder is responsive to a data code attached to a relevant stream of driving words to interrupt the reading of the stored words by the CPU while new driving words are stored in the RAM by direct memory access (DMA), and thereafter to restart the reading of data from the RAM.

8. A display as claimed in claim 1 in which each energisable display element comprises an illumination element formed by an array of high intensity light sources.

9. A display as claimed in claim 8 in which the array comprises light sources of at least two different types able to emit light of different colors.

10. A display as claimed in claim 9 in which the different types of light sources are able to emit light of red and green color.

11. A display as claimed in claim 8 in which in each illumination element the light sources are mounted on a circuit board and supported with their optical emission axes perpendicular thereto by a cover into which the light sources project.

12. A display as claimed in claim 11 in which the cover is attached to a base part enclosing therebetween the source-carrying circuit board, the connector, and a portion of cable adjacent the connector and coextensive with the circuit board.

13. A display as claimed in claim 12 in which the cover and base parts of the illumination element are joined by a plurality of fastening pins extending by way of aligned apertures in the cover and base parts and peened over externally thereof.

14. A display as claimed in claim 8 in which the light sources are high intensity light emitting diodes.

15. A display as claimed in claim 14 in which the light emitting diodes are Stanley types SBR 5501 and ESBG 5501 respectively.

16. A display as claimed in claim 1 in which the display components are attached to adjacent display components by linking members.

17. A display as claimed in claim 1 in which the one dimensional display components are located side-by-side, corresponding display elements of the display components being aligned in a direction substantially orthogonally to the extension of said display components to form a rectangular matrix of display elements.

18. A display as claimed in claim 1 in which the isolation means comprises, between each pair of adjacent sections, an electricaly insulating circuit board.

19. A display as claimed in claim 18 in which one of said circuit boards associated with each section supports said shift register associated with that section.

20. A display as claimed in claim 19 in which the sections are organized in pairs of adjacent sections and both shift registers of the pair of sections are mounted on a single circuit board.

21. A display as claimed in claim 1 in which the multiconductor cable is a ribbon cable and including insulation piercing stand-off connectors, said display elements being supported on, and electrically connected to said cable by said connectors through which electrical contact is made with appropriate power supply and switching signal conductors of the cable.

* * * * *